United States Patent [19]

Clark

[11] 3,966,102

[45] June 29, 1976

[54] SINGLE UNIT CARRIER FOR DRINKWARE

[75] Inventor: Robert T. Clark, La Mirada, Calif.

[73] Assignee: Standard Oil Company, Chicago, Ill.

[22] Filed: Aug. 8, 1974

[21] Appl. No.: 495,546

[52] U.S. Cl. ..... 224/45 A; 248/311.1; 211/74; 220/23.4

[51] Int. Cl.[2] ..... B65D 71/00

[58] Field of Search ..... 224/45.4, 46, 48 R, 224/45 A; 220/23.4, 23.83, 23.86, 85 R; 211/71, 75, 74, 76; 248/311, 111, 110

[56] References Cited

UNITED STATES PATENTS

| | | | |
|---|---|---|---|
| 1,060,048 | 4/1913 | Wetzel | 248/311 |
| 2,289,701 | 7/1942 | Engel et al. | 248/311 |
| 2,294,151 | 8/1942 | Wooten, Jr. et al. | 248/311 |
| 2,518,538 | 8/1950 | Giblin | 248/311 |
| 3,008,679 | 11/1961 | Powell | 248/311 |
| 3,477,679 | 11/1969 | Lovitz | 248/311 |

*Primary Examiner*—Frank E. Werner
*Assistant Examiner*—Kenneth Noland
*Attorney, Agent, or Firm*—Stanley M. Welsh; Arthur G. Gilkes; William T. McClain

[57] ABSTRACT

A carrier for drinkware adapted to support individual glasses or cups around the periphery of a tapered container.

7 Claims, 3 Drawing Figures

SINGLE UNIT CARRIER FOR DRINKWARE

BACKGROUND OF THE INVENTION

This invention relates to a carrier adapted to support individual glasses or cups around the periphery of a container such as a bucket containing food.

The convenience food market has become increasingly popular in recent years and the so-called "take-home" or "carry-out" restaurant businesses have demonstrated an expanding need for convenient food packaging and transporting arrangements. Many fast food chains specialize in food and drink combinations and the usual arrangement of placing food and drink in separate sacks is inconvenient for the customer in that both hands are required for carrying and the lack of means for holding the drinkware in a fixed position increases the chances of its spilling.

The carrier for drinkware of my invention can be used with a food bucket to provide a convenient means of carrying food and drink in one hand. In addition, the carrier is adapted to securely fasten and support drinkware around the periphery of the bucket so as to minimize the danger of spillage.

SUMMARY OF THE INVENTION

I have invented a carrier for drinkware adapted to support cups or glasses on a tapered container comprising:

a. a ring shaped to suspend a tapered cup or tapered glass by contact with a substantially vertical outside surface thereof;

b. means on said ring adapted to hold said ring on the lip of the container; and c. a bar having one end attached to said ring and having a free end extending downward so as to contact the outside of the tapered container and to maintain said ring parallel to the top of the container.

The object is to provide a carrier adapted to support cups or glasses on the side of a container.

In one aspect of this invention, the carrier is useful in supporting cups or glasses on any tapered container for a variety of transporting and packaging purposes.

In another aspect of the invention, the carrier is used in combination with a container, lid, and handle, the lid of the container having slots to engage the carrier thereby providing added stability. The carrier can be fastened to the lid and container package quickly and simply without the use of other devices.

The carrier for drinkware of this invention can be made out of any convenient material known in the art as having sufficient strength and rigidity while being adaptable to easy fabrication on a large scale. The preferred material is impact polystyrene which is injection molded in one piece. Other possible materials include polyvinyl chloride, ABS, acrylics, polyethylene, and polypropylene.

The container, lid, and handle are of any convenient material known in the art including any of the previously mentioned plastics. Additionally, the container and lid could be of vinyl, polyethylene, or wax-coated paperboard.

The size of the container and drinkware depends on the nature and size of the particular product being sold. The number of carriers used around the periphery of the bucket may also vary depending on the size of the customer's order. Advantageously, the carrier combination is suited for carrying a "6-pack" of drinks with sandwiches for a special price.

DESCRIPTION OF THE PREFERRED EMBODIMENT

Figure 1:
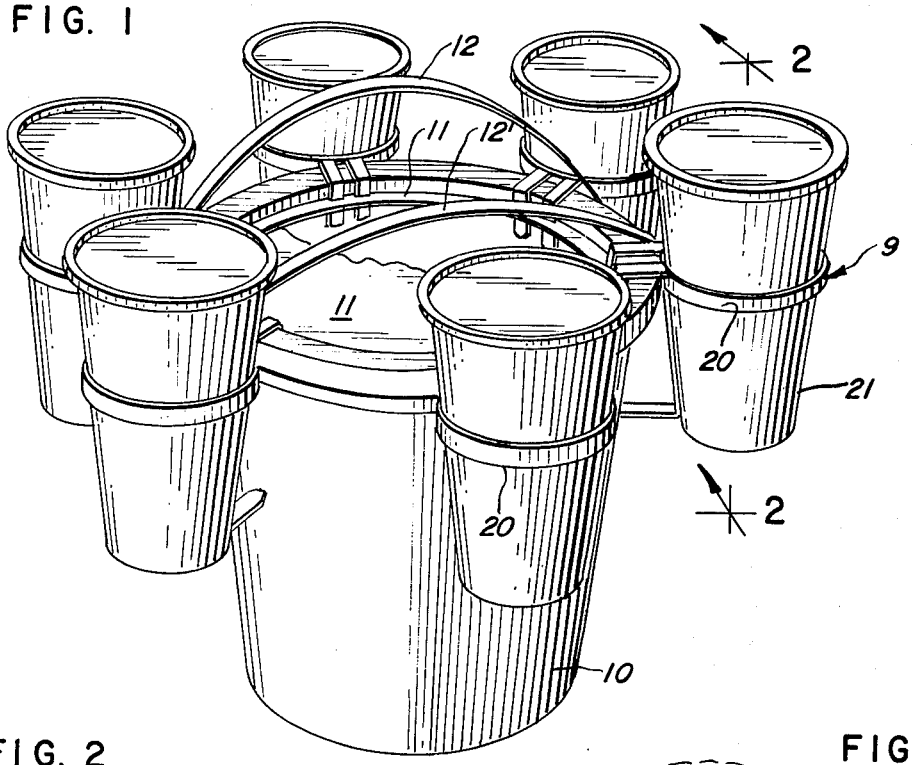
FIG. 1 of the drawing shows the combination of bucket, lid, handle, plurality of carriers, and cups.

FIG. 1 illustrates the assembled combination of tapered container 10, lid 11, handles 12 and 12', a plurality of carriers 9, and cups 21. Lid 11 is shown partially broken away in order to better illustrate the carrier attachment. The lid may be made of the same material as the container or of a suitable transparent material in order that the contents of the bucket be visable when the lid is in place.

Figure 2:
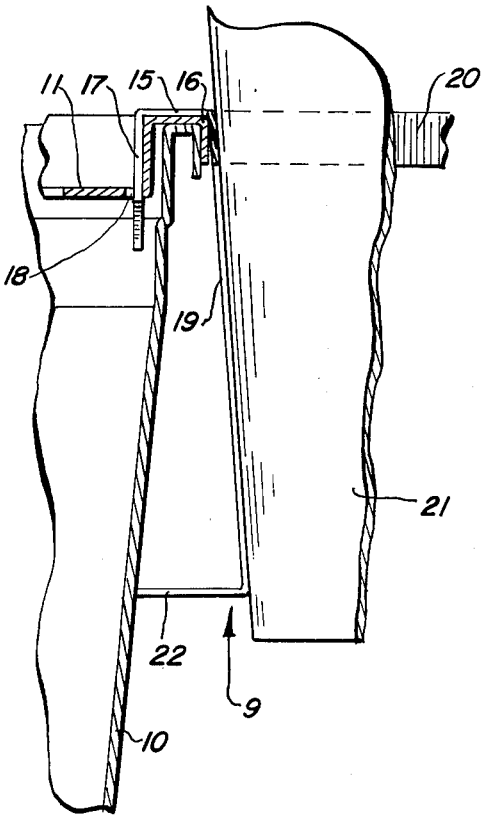
FIG. 2 of the drawing shows a cross sectional view on line 2—2 of FIG. 1 showing a single carrier in place on the bucket.

FIG. 2 is a cross section showing a single carrier 9 in place on the container 10. Horizontal arm 15 extends over the lip 16 of lid 11 and downwardly extending arm 17 passes through slot 18 in container lid 11. Bar 19 is attached to ring 20 and extends downward to provide support for cup 21. The free end of bar 19 is bent to form support leg 22 which contacts container wall 10 and is of sufficient length to maintain ring 20 parallel to the top of the container when the carrier is in place.

Figure 3:
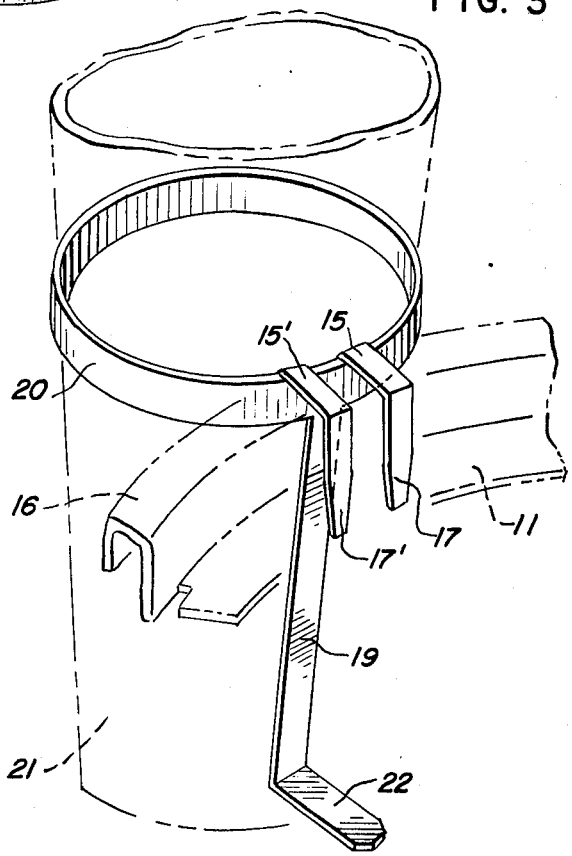
FIG. 3 of the drawing shows a single carrier, cup section, and slotted bucket lid with parts broken away.

The preferred specific embodiment of this invention as illustrated in FIG. 3 is a single unit of injection molded impact polystyrene forming ring 20, horizontal arms 15 and 15', downwardly extending arms 17 and 17', bar 19, and support leg 22. Bar 19 is attached to ring 20 essentially mid-way between horizontal arms 15 and 15'. Also shown in FIG. 3 are container lid 11 with parts cut away and cup 21.

The carrier of this invention is not limited to use with the container and lid described in the preferred embodiment buy may be used with any tapered container or bucket by slipping the horizontal arms 15 and 15' over the lip of the particular container so that downwardly extending arms 17 and 17' pass into the inside of the container. Such an arrangement, however, lacks the stability achieved by the use of the slotted lid previously described and increases the chance of spillage. Further, a single arm 15 and single downwardly extending arm 17 can be substituted for the pairs of each of these in the preferred embodiment.

Those skilled in the art will recognize that many variations can be made in the carrier disclosed herein which will come within the scope of the invention.

We claim:

1. A carrier for drinkware adapted to support tapered cups or glasses on a container having a bottom, an open top and a tapered sidewall extending therebetween comprising:

a. at least one ring shaped to suspend a tapered cup or tapered glass by contact with a substantially vertical outside surface thereof;

b. at least one flange attached to said ring adapted to hold said ring to the container, wherein said flange is bent to provide a horizontal arm sufficiently long to extend across a lip of the container and an arm extending downwards from the end of the horizontal arm into the inside of the container and where said container is provided with a lid having a plurality of slots whereby said at least one flange is received therein; and c. a bar having one end attached to said ring and having a free end extending downward so as to contact the outside of the tapered container and to maintain said ring parallel to the top of the container.

2. The carrier of claim 1, wherein there is one flange and said bar is attached essentially below said flange.

3. The carrier of claim 1, wherein there are two flanges and said bar is attached essentially mid-way between said two flanges.

4. The combination of a tapered container and plurality of carriers according to claim 1 supported thereon.

5. The carrier of claim 1, wherein there is only a single ring shaped to suspend a tapered cup or tapered glass by contact with a substantially vertical outside surface thereof.

6. The carrier of claim 5, wherein said bar is also in contact with an outside surface of a cup or glass whenever said cup or glass is being supported in said carrier.

7. A carrier for drinkware adapted to support tapered cups or glasses on a container having a bottom, an open top, and a sidewall extending therebetween comprising:

a. a single ring shaped to suspend a tapered cup or tapered glass by contact with a substantially vertical outside surface thereof;

b. a lid provided with a plurality of slots being attached to the container;

c. a pair of flanges attached to said ring adapted to hold said ring to the container, wherein each flange is bent to provide a horizontal arm sufficiently long to extend across the lip of the container and an arm extending downwards from the end of the horizontal arm adapted to pass through a slot in the lid and into the inside of the container; and d. a single bar having (1) one end attached to said ring essentially mid-way between said flanges, (2) the other end extending downward so as to contact the sidewall of the container and thereby maintain said ring parallel to the top of the container.

* * * * *